United States Patent [19]

Clark

[11] Patent Number: 4,591,190

[45] Date of Patent: May 27, 1986

[54] VOUCHER WITH SELF-CONTAINED VERIFICATION MEANS

[75] Inventor: Fred C. Clark, Mississauga, Canada

[73] Assignee: Canadian Security Printers Inc., Mississauga, Canada

[21] Appl. No.: 530,736

[22] Filed: Sep. 9, 1983

[51] Int. Cl.[4] ..... B42D 15/00

[52] U.S. Cl. ..... 283/102; 283/903; 273/139

[58] Field of Search ..... 283/100, 102, 903; 273/139, 269, 270

[56] References Cited

U.S. PATENT DOCUMENTS

| | | | |
|---|---|---|---|
| 3,351,005 | 11/1967 | Giori | 283/903 X |
| 3,829,133 | 8/1974 | Smagala-Romanoff | 283/6 |
| 3,950,013 | 4/1976 | Tagliaferri | 283/6 |
| 4,095,824 | 6/1978 | Bachman | 283/102 |
| 4,174,857 | 11/1979 | Koza | 283/903 X |
| 4,191,376 | 3/1980 | Goldman et al. | 283/102 X |
| 4,241,942 | 12/1980 | Bachman | 283/102 |
| 4,299,637 | 11/1981 | Oberdeck et al. | 283/903 X |

FOREIGN PATENT DOCUMENTS

| | | |
|---|---|---|
| 1101462 | 5/1981 | Canada . |
| 1135574 | 11/1982 | Canada . |

*Primary Examiner*—Robert L. Spruill
*Assistant Examiner*—Taylor J. Ross

[57] ABSTRACT

A voucher resistant to tampering, having self-contained means for verifying the authenticity of said voucher. At least two correlated identifying indicia are applied to the top surface of the voucher substrate. A layer of release coating is applied over one identifying indicia, and a cover layer (preferably opaque) of removable coating is applied over the release coating layer. The relative adhesive qualities of the layers are selected to render ordinary use of the voucher easy but tampering difficult.

4 Claims, 7 Drawing Figures

VOUCHER WITH SELF-CONTAINED VERIFICATION MEANS

FIELD OF THE INVENTION

This invention relates to vouchers generally and more particularly to vouchers resistant to tampering and alteration by a holder other than the issuer.

BACKGROUND OF THE INVENTION

Lottery ticket vendors are frequently required to provide cash prizes to holders of winning tickets upon presentation of winning tickets. Normally, for substantial cash prizes, the vendor is required to obtain the assistance of a computer check or a check by some other centralized facility to verify that the ticket presented to him is authentic. To this end, the ticket bears in addition to "the winning number", also a computer verification number or the like. However, this method of verification is only convenient and economical for prizes above a fixed value. In recent years, lottery organizations have introduced increasing numbers of low cash prizes in addition to the large cash prizes, in order to attract a greater number of buyers. Obviously, the temptation exists to alter the numbers on a non-winning ticket to render such an apparent "winning" ticket. It is therefore desirable to provide a relatively tamper-proof ticket bearing self-contained verification features so that the ticket vendor can immediately and simply verify low cash prize tickets.

It has been found that computer printed and numbered tickets can be made which attain a high degree of security. The computer allocated number is cross-referenced to a second printed number and maintained in secrecy within the computer program algorithm itself. However, apparent low cash prize-winning tickets are not normally verified for authenticity by the vendor with the assistance of a computer—such means of verification would be too time-consuming and expensive. In such cases, the visible printed number on the ticket can be fairly easily scraped off and modified so as to present a winning number to permit the holder to falsely claim the prize. It is desirable therefore to provide on the ticket some means by which a vendor without access to a computer or central directory could readily determine whether or not a low-cash-prize ticket had been tampered with.

A game ticket has been designed which conceals information applied to the base sheet of instant prize lottery tickets in order to prevent the vendor of the tickets from selecting winning tickets for his own use while leaving the losing tickets for buyers. This design is used to conceal unknown information from the vendor and purchaser prior to sale. A disadvantage of the design is that it requires an additional back sheet or light-blocking patch attached to the base sheet if the concealed information is applied to the base sheet using impact printing, because the indentation of the paper, produced on impact, would be observable on viewing the back of the ticket. Furthermore, this design requires that the scratch-off coating and the underlying surface of the base sheet be completely opaque and resistant to external viewing means such as a very strong light.

A coded lottery ticket has been designed whereby a verification code is placed on the ticket surface and concealed with a scratch-off coating. When presented with an apparent winning ticket, the vendor removes the scratch-off coating to obtain the code number assigned to the ticket. He then calls upon some external means, such as a master list, to cross-reference the ticket identified with the code in order to verify that the ticket is authentic. This design is used to prevent tampering with the ticket where the coding technique alone is not acceptably secure. The disadvantage of this design is that the vendor is required to reveal the code number and invoke the assistance of a third party or document in order to verify the authenticity of all winning tickets presented to him.

SUMMARY OF THE INVENTION

The present invention is a voucher for use as a low cash prize lottery ticket (or for any other comparable purpose not requiring independent verification by computer check or the like). It is designed in such a way as to be convenient to use and read by both the issuer's agent and by the purchaser or recipient, while at the same time being relatively tamper-proof.

According to the present invention, identifying indicia, such as printed numerals, are applied to the substrate of the voucher (e.g. a paper or coated paper base) in at least two locations. The two sets of indicia are either identical to one another or apparently and obviously correlated to one another. A transparent release coating layer is applied to the upper surface of at least one of the sets of indicia. A readily removable outer coating which breaks apart upon removal overlies the release coating. A property of the release coating is relatively high adhesion to the substrate and relatively low adhesion to the outer coating layer. A property of the outer coating material is relatively high adhesion to the substrate, and a second property is its tendency to disintegrate in the process of being removed.

The outer coating layer may, for example, be removed by rubbing a sharp edge over the surface of the coating whereby the coating breaks up into particles which cannot readily be re-applied to the ticket to restore the ticket to a state similar in appearance to that existing prior to the removal of the outer coating layer. It is preferable that the outer coating be opaque and made of material which does not soil skin or clothing, in order that the person removing it can easily determine whether the coating has been removed and does not obtain soiled fingers in doing so. (Such removable outer coatings have been known heretofore for other purposes).

In typical use, the voucher is issued to the recipient with one set of indicia (e.g. a number) covered by the release layer and opaque outer layer and the other set plainly visible. After winning numbers are announced, the recipient of a ticket voucher bearing a winning number presents his voucher to the issuer's agent. The agent scratches off the opaque layer covering the other set of indicia. If the two sets of indicia (e.g. two numbers) match, a prize is awarded to the recipient.

Suppose that a winning number is 20937918 and the recipient holds a ticket bearing number 20737919. He may be tempted to tamper with his ticket to alter the third digit from 7 to 9 and the last from 9 to 8 so as to present a winning ticket to the issuer. While he may be readily able to do this in the case of the plainly visible number, he cannot readily do so for the covered number. To get at the printed number under the opaque layer, he must scratch away and disintegrate the opaque layer, and must also remove the release layer. Both of these are difficult to replace without evidence of tampering, because of the material properties mentioned above. Typically the expense of alteration and repair may be as much as the award on a low cash prize-winning ticket.

It is necessary to apply a release coating over the printed area upon which it is desired to apply a covering layer of scratch-off coating, because the print ink adheres to the scratch-off coating and would result in the relative inability of the issuer's agent to remove the scratch-off coating upon presentation of an apparent winning ticket or in the removal of both the printed indicia and the scratch-off coating together.

A preferred embodiment of the invention is a voucher (which could for example be a lottery ticket or goods claim ticket where immediate verification of authenticity by the issuer's agent is desirable) comprising two identical but separately located sets of indicia printed on the upper surface of the substrate. The first indicia are plainly visible. A release coating layer is applied over the second indicia extending over an area which is larger than the area of the ticket covered by the second indicia. The release coating layer is preferably comprised of a transparent ultraviolet-cured ink. The release coating is then covered with an outer coating comprised of opaque ultraviolet-cured ink. Words similar to "VOID IF REMOVED" surrounded by a line pattern are printed over the outer coating wherein said line pattern extends beyond the perimeter of the outer coating onto the surface of the substrate so that any subsequent outer coating applied by a tamperer would have to present to the eye a matching line pattern in order to avoid detection.

Unlike prior designs, the present invention does not require the protected second indicia which underlie the scratch-off coating to be secure from observation or detection, because they are known and equivalent to the first indicia which are apparent on the face of the ticket. It is unnecessary therefore to include additional security means on the back of the ticket or otherwise to prevent detection of the second indicia.

As a further preferred option, according to the present invention, the elements of the second indicia are smaller than those of the first and are laterally randomly positioned from ticket to ticket within an area of the ticket which extends laterally from each side of the ticket. Random positioning of the indicia is most easily achieved using computer-directed printing. The release coating and scratch-off coating layers are then applied over both the second indicia and an area extending laterally from the second indicia to the left and right sides of the ticket. This feature provides additional security to the ticket because a tamperer wishing to cut out a numeral from within the ticket number to replace it with a numeral from a different ticket, using adhesive, would have to know where the covered numeral is located under the outer coating in order to be able to cut it out. It has been found that where the location of the covered number is fixed, a tamperer can cut out an unwanted numeral from both numbers appearing on the ticket and replace them with the desired numeral from some other ticket, using adhesive, to create a ticket bearing a winning number. If, however, the tamperer cannot determine where the undesired numeral is located without removing the outer coating layer, he cannot successfully cut it out from the ticket, nor could he cut out the number from another ticket.

The principal advantage of the present invention is the provision of verification means which are self-contained within each ticket. The authenticity of the ticket can be readily determined without the assistance of a computer or centralized directory. This is advantageous because often lottery ticket vendors operate from the street or shopping mall booths without ready access to telephones or similar facilities. It is also advantageous because for small cash prizes or ticket prizes it is both inconvenient and uneconomical to use centralized verification procedures. It is expected that the present invention will deter a significant proportion of potential tamperers because an attempt to modify the ticket will typically result in perceptible damage to the ticket unless the tamperer uses the various specialized devices which perform the steps of like printing and scratch-off coating application, which, as pointed out, entail considerable expense, time and risk to potential tamperers.

SUMMARY OF THE DRAWINGS

An embodiment of the invention will now be described, by way of example only, with reference to the following drawings, in which.

DETAILED DESCRIPTION OF THE PREFERRED EMBODIMENT

It is to be understood that the drawings are for illustrative purposes only, and the elements shown therein may not necessarily be shown to scale or contain all possible desirable features. The size, position, etc. of various elements may be exaggerated for the sake of clarity. Like numerals refer to like parts throughout.

TICKET LAYOUT

Figure 1:
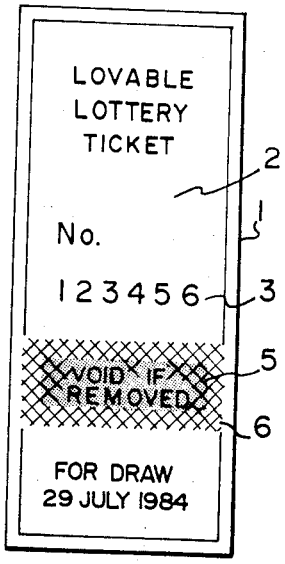
FIG. 1 is a plan view of a specimen ticket voucher according to an embodiment of the present invention showing a ticket in the form it would be sold wherein the first indicia are readily observable to a viewer and there is observable an area of the ticket covered with an outer layer comprised of opaque material and overprinted with a design pattern.
Figure 2:
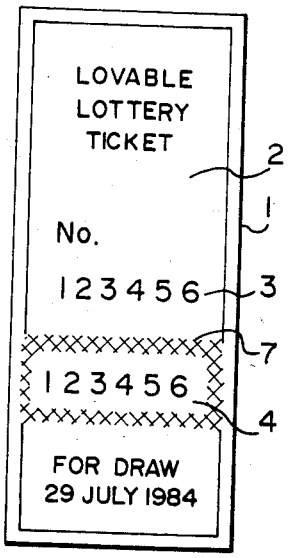
FIG. 2 is a top view of the specimen ticket voucher of FIG. 1 after the outer coating layer has been removed to verify the authenticity of the ticket, revealing the second indicia which were applied to the ticket below the outer coating layer prior to the application of the outer coating layer.

Referring now to FIGS. 1 and 2, a ticket 1 according to the present invention as typically used is illustrated. In FIG. 1, a substrate 2 such as stiff paper bears first identifying indicia 3 (here the printed number 123456) which have been applied to the outer surface of the ticket 1 and are readily observable. Second indicia 4, in this case the identical printed number 123456 have been applied to the ticket (see FIG. 2) and then covered with an opaque layer 5 (see FIG. 1) according to the invention (described more fully below) and overprinted with a design pattern 6 to protect the underlying indicia 4. The design pattern 6 extends beyond the opaque layer 5 to adjoining areas of substrate 2.

FIG. 2 shows the ticket of FIG. 1 after the outer coating layer 5 has been removed to verify that the ticket is authentic. (Note that the outermost fringe 7 of design pattern 6 remains on the substrate 2 after layer 5 has been scratched off, since pattern 6 extends beyond the edges of layer 5, as mentioned.)

To determine whether the ticket is authentic (i.e. that the ticket was issued bearing the same two sets of identifying indicia 3, 4) the issuer would receive the ticket as shown in FIG. 1, remove the opaque coating layer 5, and examine the underlying indicia 4 appearing on the ticket. If the indicia 4 are the same as the indicia 3 appearing on the ticket, then the ticket may be assumed to be authentic.

Although it is normally convenient to use two sets of identical numbers as the first and second indicia, this is not absolutely necessary. The rules of the lottery might provide that the second number be double the first, for example. Or the first indicia might be a set of words for objects, e.g. "BELL GRAPES BELL BELL LEMON ORANGE" and the second indicia might comprise pictorial representations of these objects in the same sequence.

TICKET STRUCTURE

Figure 3:
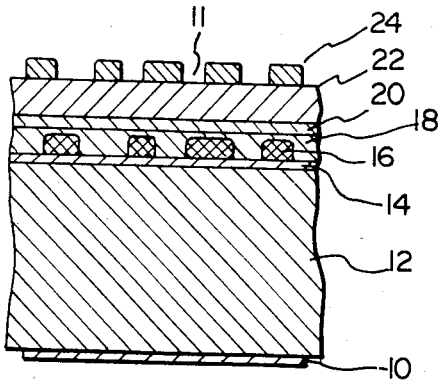
FIG. 3 is a schematic sectional front view of a portion of a ticket voucher made in accordance with the present invention wherein the indicia are applied to the ticket using xerographic printing, the release coating is applied to the ticket using flexographic printing and is comprised of an ultraviolet-cured ink and the scratch-off coating is applied to the ticket using letterpress printing and is comprised of an ultraviolet-cured ink.

FIG. 3 shows in partial section the preferred embodiment of the present invention, taken in the vicinity of the area of application of the second indicia. The ticket or voucher 11 includes a substrate 12 comprised of paper. Lithographic printing 14 (typically identifying the lottery, business, etc. and typically including a design) is applied over the substrate. Ticket indicia 16, e.g. numbers (here the second indicia) are printed or otherwise suitably applied over the lithographic printing. A lower layer 18 and an upper layer 20 of release coating are applied over the indicia. The application of two discrete layers of release coating has a desirable smoothing effect. A scratch-off opaque coating layer 22 is applied over the release coating and thereover is applied on optional overprint design 24. (Compare design 6 of FIG. 1) A layer of black ink 10 is applied to the bottom surface of the substrate using conventional lithographic or flexographic printing, to optically mask printed matter appearing at the top surface of the substrate. It is not strictly speaking necessary that layer 22 be opaque and that layer 10 be present, but opacity is desirable as having an additional deterrent effect. It is also desirable that the outer layer 22 be opaque in that the issuer's agent can then readily determine whether or not the outer layer 22 (or part thereof) has been removed or tampered with prior to presentation since the contrast of appearance between an opaque material and the ticket substrate would typically be readily noticeable.

The various layers have the properties of relative adhesion previously mentioned. That is, the adhesion between the release coating layers 18, 20 and substrate 12 (and any lithographic overlay 14 or the like on the substrate) is high, as is the adhesion between the scratch-off coating layer 22 and substrate 12 (and any lithographic overlay). The adhesion between the release coating layers 18, 20 and scratch-off coating layer 22 however is low (this depends on surface smoothness at the interface between such layers as well as upon the material composition of such layers).

The foregoing properties, plus the tendency of the scratch-off layer to disintegrate when removed by a blade or the like, render difficult the successful tampering with such voucher. A tamperer cannot alter a ticket number without removing both the scratch-off layer and the release layers. These acts of removal in and of themselves are difficult to perform without destruction of part of the ticket or visibly apparent alteration of a significant visible area. If, after removal of these layers and alteration of the number, such tamperer applies scratch-off coating without first re-applying a suitable release coating, the scratch-off layer then cannot be removed in the ticket vendor's presence without doing obvious damage to the ticket of a character not associated with a genuine ticket. If additionally the scratch-off coating contains an applied pattern, the job is made that much more difficult for the tamperer.

Figure 4:
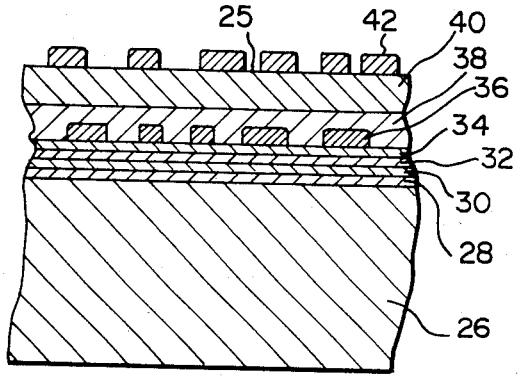
FIG. 4 is a schematic sectional front view of a portion of a ticket voucher made in accordance with the present invention wherein the indicia are applied to the ticket using ink jet printing, the release coating and scratch-off coating are applied to the ticket using screen printing, the release coating is comprised of an oil based ink and the scratch-off coating is comprised of a latex ink.

FIG. 4 shows a partial section view of an embodiment of the present invention again in the vicinity of the second indicia. The ticket 25 includes a substrate 26 comprised of foil laminated cardstock, a ply of metal foil 28 overlying the subtrate, a metal priming layer 30 applied over the metal foil to provide a surface which is receptive to lithographic or flexographic printing, lithographic or flexographic printing 32 applied over the metal primer, an ink jet receptive coating layer 34 applied over the lithographic printing to provide a surface to which ink jet printing may be applied, ticket indicia 36 applied over said coating layer using ink jet printing, a release coating layer 38 applied over the indicia, a scratch-off coating layer 40 applied over the release coating, and an overprint design 42. Again the adhesive properties of the various layers is as previously described.

Figure 5:
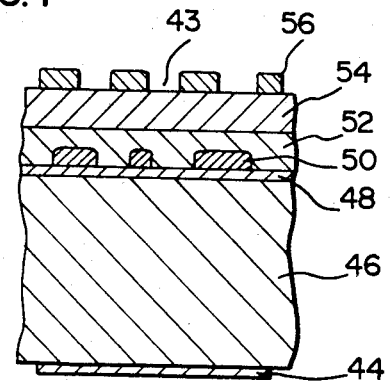
FIG. 5 is a schematic sectional front view of a portion of a ticket voucher made in accordance with the present invention wherein the indicia release coating and scratch-off coating are applied to the ticket using lithographic printing, and the release coating and scratch-off coating are comprised of oil-based ink.

FIG. 5 shows a partial section view of an embodiment of the present invention again in the vicinity of the second indicia. The ticket 43 includes a substrate 46 comprised of coated paper or cardstock, lithographic printing 48 applied over the substrate, ticket indicia 50 applied over the lithographic printing, a release coating layer 52 applied over the indicia, a scratch-off coating layer 54 applied over the release coating and an overprint design 56. A layer of black ink 44 is applied to the bottom surface of the substrate using conventional lithographic or flexographic printing to optically mask printed matter appearing at the top surface of the substrate. Once more the adhesive properties of the various layers is as previously described.

Figure 6:
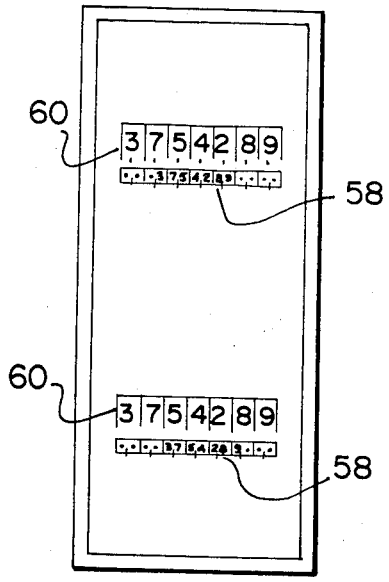
FIG. 6 is a top view of a specimen ticket voucher according to the invention which includes additional security means to deter tamperers from cutting out an unwanted numeral within the ticket number and replacing same with the desired numeral from another ticket. The security means illustrated to achieve this result comprises random lateral positioning (from ticket to ticket) of the elements constituting the second indicia across the face of the ticket, together with a difference in size between the first and second indicia. The ticket is shown as printed before application of the release coating layer and outer coating layer, or after removal of the outer coating layer, to expose the second indicia.

FIG. 6 shows a ticket which provides additional security means to the preferred embodiment of the present invention. The second indica 58 printed on the ticket are positioned randomly (from ticket to ticket) in a lateral direction across the face of the ticket. The size of the numerals of the second indicia are smaller than those of the first indicia 60. Applied over the second indicia are the release coating, scratch-off and overprint design layers as individually shown in FIG. 3.

Figure 7:
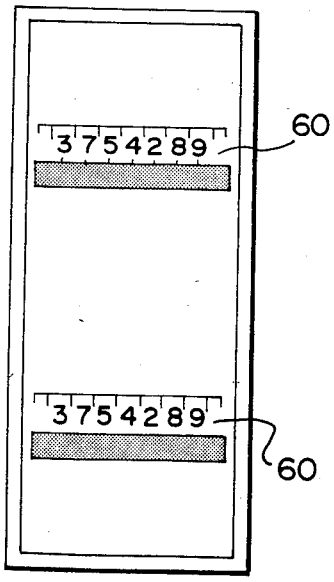
FIG. 7 is a top view of the ticket of FIG. 6 showing the ticket as sold, with the release and outer coating layer applied over the second indicia to mask the same from view.

FIG. 7 is a top view of the ticket illustrated in FIG. 6 showing the scratch-off coating layer positioned over the second indicia and near lateral area.

The FIGS. 6–7 embodiment presents the would-be tamperer with yet another hurdle. If he buys two or three tickets intending to cut out numerals from one or two to replace numerals masked on the third, he will be unable to know where to locate the smaller numerals comprising indicia 58, because positioning is random.

Those skilled in the art will recognize that there are many methods of applying numbers and other information to materials. Such methods include letterpress printing, lithographic printing and xerographic printing. The present invention is suitable for practice utilizing any of these methods, but in particular the xerographic computer directed printing method may be preferred because it can also simultaneously provide high security for high cash prizes on the same lottery. If xerographic printing is used for the printing of indicia in the present invention, high cash prize security means and low cash prize security means can be readily incorporated into every ticket while using only one method of applying indicia to the ticket.

It is instructional to describe individually, by way of separate headings for each layer, the composition, purpose and method of applying the various layers overlying the second indicia which comprise the present invention. The descriptions contained under the following headings refer to the layers contained in the three embodiments of the present invention which are disclosed by way of example and illustrated in FIGS. 3–5. It is possible that a different combination of printing methods and/or materials would be desirable in a particular case, in which case, additional considerations or steps might be necessary to satisfactorily implement the present invention. The embodiments of the present invention illustrated in FIGS. 3–5 are given by way of example only and were chosen because they collectively utilize the more common printing methods used in the printing industry.

SUBSTRATE

The substrate used will depend on the printing method chosen to apply the indicia to the ticket. For example, if xerographic printing is to be used the substrate must be comprised of paper stock to which a xerographic toner image can be fused. Similarly, lithographic printing is normally applied to a substrate comprised of paper because paper is absorbent to oil-based inks which are used in lithographic printing.

It may be desirable to print a lithographic layer over the chose substrate prior to the application of the ticket indicia, depicting some characteristic design which denotes the game type, the ticket series, the issuing company name etc. If so, the substrate must be receptive to oil-based inks used in lithographic printing. Paper or coated paper satisfy this condition. Foil or foil laminated cardstock do not. If a foil or foil laminated cardstock substrate is used and a lithographic layer is desired, a metal priming layer which produces a surface receptive to ink must be applied over the foil before the lithographic layer is applied.

It is also desirable that the substrate be conditioned prior to the application of ticket indicia so as to make the substrate, or substrate and receptive coating and/or lithographic layers, non-absorbent. This is because it is necessary that the outer surface of the final layer of release coating be smooth. If it is not, the scratch-off layer will adhere to the release coating at points of surface irregularities. This is because the scratch-off ink penetrates into minute holes at those points and is not contacted by a blade or sharp edge passed over the surface to remove the scratch-off coating. An absorbent substrate would tend to absorb the release coating ink as it is applied and before it has levelled, so that the substrate would absorb the ink over the surface unevenly and result in an unevenly distributed release coating layer which is non-smooth.

There are several means to prepare the substrate material for the release coating. If a metal foil laminated cardstock substrate is used such substrate has low absorbency to oil-based (or water-based) inks and requires no further conditioning to create such property of non-absorbency. Paper stock substrate on the other hand, is absorbent to oil-based (and water-based) inks and requires some form of conditioning to reduce the absorbency of the substrate. This may be done by coating the paper with a material which is non-absorbent to inks (of which there are many known in the industry) or it may be accomplished by coating the paper with a layer of release coating and immediately thereafter curing the release coating to seal the paper surface. The subsequent layers of release coating will then have a greater tendency to remain on the surface of the paper and level out to form a smooth surface.

As mentioned above, the substrate 12 of the ticket in the preferred embodiment illustrated in FIG. 3 is comprised of paper stock overprinted with lithographic printing. To this end, the ticket indicia are laser printed using a xerographic toner image. Other methods of printing the indicia could be used, for example ink jet printing, which would use a substrate comprised of metal foil laminated cardstock as shown in FIG. 4, or lithographic printing which would use a substrate comprised of coated paper or cardstock as shown in FIG. 5.

A desirable property of the substrate or layer below the release coating is low absorbency because it is necessary that the release coating settle smoothly over the substrate rather than be absorbed unevenly into the substrate. In order to achieve this characteristic, in the embodiment of FIG. 3 the area of the substrate and lithographic printing layer which is intended to be covered by a release coating layer and a scratch-off coating layer is sealed by coating the area with a transparent ultraviolet-cured ink 18 and exposing it immediately thereafter to an ultraviolet light source. In the embodiment illustrated in FIG. 4, the substrate 26 is non-absorbent foil laminated cardstock which does not require sealing. If the embodiment illustrated in FIG. 5 is used, the paper substrate 46 should be coated to provided low absorbency to the release coating layer.

In the embodiment of FIG. 3, the lithographic printing layer may be omitted if desired, so that the xerographic toner image 16 could be applied directly to the paper 12. The sealing layer of release coating 18 would then be applied over the toner image as described above.

If the embodiment of FIG. 4 is chosen to print the indicia using ink jet printing, a coating of metal primer 30 should be applied over the foil 28 before lithographic printing can be applied to the substrate. This coating is desirable because the metal surface does not readily adhere to the lithographic ink which is comprised of oil-based ink. An alternative to using a metal primer coating would be to oxidize the foil surface, thereby creating a rough surface receptive to ink. If a lithographic printing layer is desired, it is also necessary to cover the lithographic printing layer 32 with a coating of material 34 which is receptive to water-based ink, for example a vinyl, because the ink used in ink jet printing is water-based and non-adherent to the oil-based inks which are used in lithographic printing.

RELEASE COATING

Where it is desired to apply a removable (scratch-off) coating layer so that upon removal of said coating an underlying layer of printed matter (e.g. a lithographic layer and/or printed indicia) is fully revealed, it is necessary to first apply a release coating layer over the said printing layer(s). This is because printing inks (e.g. lithographic inks, xerographic inks, ink jet inks, letter press inks, etc.) generally adhere to the inks comprising the scratch-off material. Without some intermediary layer existing between the print layer and scratch-off layer, which does not adhere to the scratch-off layer, it would be difficult to remove the scratch-off layer as described. Therefore, it is desirable to apply a release coating layer over the final print layer to be covered by scratch-off coating, wherein such release coating material has low adhesion to the scratch-off material but adheres relatively strongly to the print layer.

It is also desirable that the release coating layer be transparent in order that the printed indicia underlying the release coating layer may be readily observed upon removal of the scratch-off layer.

The release coating in the preferred embodiment of FIG. 3 is preferably comprised of a transparent ultraviolet-cured ink and applied using flexographic printing. Following the first sealing layer of release coating 18 described above, a second layer 20 is applied over the first, is then given a short time to level, and then is cured by ultraviolet light. (It is desirable that the release coating be given a sufficient amount of levelling time to enable the coating to level and acquire surface smoothness). It has been found that surface smoothness is an essential characteristic of the release coating because the adhesion of the scratch-off coating to the release coating increases with decreasing smoothness of the release coating. If desired, a second or third layer of release coating may be applied for additional smoothness.

If the release coating is to be printed using screen printing as illustrated in FIG. 4, the release coating ink used would be a solvent-evaporated ink and heat would be used to evaporate the solvent. The usual disadvantages of using the screen printing method of applying the coating are (1) it requires a two stage manufacturing process; (2) it produces undesirable solvent emissions; and (3) it requires high energy consumption.

If the release coating were printed using lithographic printing as illustrated in FIG. 5, an oil-based ink would be selected. Oxidative drying inks (such as oil-based inks for use in lithographic printing) require approximately 24 hours to dry after application, which means that the release coating application according to the embodiments illustrated in FIG. 5 would have ample time to level and attain smoothness, but the delay time may be commercially unacceptable. (A 24-hour period is necessary to dry the release coating to a point at which it will have acceptably low adhesion to the scratch-off coating.)

SCRATCH-OFF COATING

A scratch-off coating is desired which is readily removable by rubbing a sharp edge over the surface, which is made of non-soiling material, and which disintegrates upon removal so that someone desiring to remove the scratch-off layer can do so conveniently, but so that once removed the scratch-off layer cannot be conveniently restored. Latex inks are commonly used for scratch-off coatings applied using screen printing. Oil-based inks are commonly used for scratch-off coatings applied using lithographic printing. Alternatively, an ultraviolet-cured ink may be desired to reduce the drying time necessary. As discussed above however, the material comprising the scratch-off layer must have low adhesion to the release coating (i.e. the layer underlying the scratch-off layer) in order to be able to readily remove it when desired. It is also desirable that the scratch-off material be opaque to increase deterrence to tampering with the ticket and to assist the issuer's agent in removing the scratch-off layer by providing him with a material whose removal he can easily moniter.

In the preferred embodiment of the present invention illustrated in FIG. 3, the scratch-off coating 22 is preferably comprised of opaque ultraviolet-cured ink and is applied over the release coating layers using letterpress printing. The scratch-off coating may be applied over the last release coating layer as soon as that release coating layer has been cured under ultraviolet light. It is preferable that the scratch-off layer cover both the area to which the release coating has been applied and an area which extends beyond the perimeter of the area covered by the release coating in order to securely fix the release coating layer to the ticket (i.e. since there is high adhesion between the scratch-off coating and the substrate or lithographic printing as the case may be). This also provides additional security against tampering with the ticket because the area near the perimeter of the scratch-off coating adheres relatively strongly to the ticket and any subsequent scratch-off coating layer applied by a tamperer would be detectable upon observing a thicker area of scratch-off coating near the perimeter of the scratch-off coated area.

If the embodiment of FIG. 4 is chosen, the scratch-off coating layer 40 would comprise a latex ink and be applied over the release coating layer using screen printing.

The embodiment illustrated in FIG. 5 uses a scratch-off coating material 54 comprised of an oil-based ink and is applied over the lease layer using lithographic printing.

It may be desirable in some cases (such as instant-win games) that the indicia underlying the scratch-off coating be masked from external view. To achieve this characteristic a stopout coating of black ink could be applied to the bottom surface of the substrate as illustrated in FIGS. 3 and 5, using conventional lithographic or flexographic printing. The black ink provides an optical barrier to the ticket indicia overlying the substrate on the top surface. If a substrate of metal foil laminated paper is used, as in FIG. 4, it is unnecessary to coat the bottom surface with a stopout layer since the metal foil provides a barrier to viewing the top surface of the substrate.

As briefly mentioned above, a desired feature of an embodiment of the present invention as illustrated in FIG. 1 is to overprint the scratch-off coating with a design comprised of the words "VOID IF REMOVED" or similar surrounded by a line pattern wherein the line pattern extends beyond the perimeter of the scratch-off coating onto the substrate (or substrate overprinted with lithographic or other printing as the case may be). This feature of the ticket provides additional security against modification of the ticket number by providing a line pattern which, at the outer edges, has high adhesion to the substrate of the ticket and which lines up with a line pattern covering the scratch-off coating. In order to successfully modify the number underlying the scratch-off a tamperer would have to be successful in matching up the lines adhering to the substrate with the forged lines. Alternatively, such tamperer would be forced to try to remove the lines adhering to the substrate and this would likely result in perceptible damage to the ticket. Several methods of printing could be used to overprint the design onto the scratch-off coating and substrate such as letterpress printing and flexographic printing. It is preferable that the ink used to overprint the design comprise material which is compatible with the scratch-off coating ink, for example a solvent sensitive ink should be used if a latex material is used for the scratch-off coating.

Those skilled in the art will understand that, while the present invention has been described and illustrated with respect to the preferred embodiment, numerous variations may be made without departing from the scope of the invention which is defined in the appended claims.

What is claimed is:

1. A family of vouchers, each voucher comprising a substrate:

correlatable first and second identifying indicia located in separate locations on a surface of the substrate, the first indicia in a first of the locations being visible to the eye in the original condition of the voucher; the second indicia being located at a second of the locations;

a release coating layer at the upper surface of the second indicia; and a readily removable outer coating layer overlying the release coating layer; wherein the materials of which the substrate, indicia and layers are made at least in the vicinity of the second location are selected and the surface conditions of the substrate and layers at least in the vicinity of the second location are selected such that the adhesion between the release coating layer and the outer coating layer is relatively low, the adhesion between the release coating layer and the substrate is relatively high, the adhesion between the outer coating layer and the substrate is relatively high, and the outer coating layer tends to disintegrate as a consequence of the step of removing same, such that upon removal of the outer coating layer, the second indicia in the second location are visible to the eye, the second indicia being difficult to alter without detection by reason of the said selections;

each voucher in the family of vouchers having individual and unique identifying indicia, and wherein the elements constituting the second indicia are in at least one dimension randomly spaced on the voucher within the area covered by the release coating and outer coating layers so that the exact location of the elements constituting the second indicia cannot be readily determined without removing the outer coating layer.

2. A family of vouchers as defined in claim 1, wherein the release coating and outer coating layers cover an area of the ticket which extends beyond the area covered by the second indicia.

3. A family of vouchers as defined in either of claims 1, 2, wherein the size of the elements constituting the second indicia differs from the size of the elements constituting the first indicia.

4. A family of vouchers as defined in either of claims 1, 2, wherein for each voucher in the family of vouchers the outer coating layer is opaque, the substrate has a relatively smooth surface to which at least the second indicia and layers are applied, and the upper surface of the release coating layer to which the outer coating layer is applied is a relatively smooth surface substantially free of surface irregularities to which the outer coating layer might tend to adhere unduly strongly.

* * * * *